US009157189B2

(12) United States Patent
Heiskanen et al.

(10) Patent No.: US 9,157,189 B2
(45) Date of Patent: Oct. 13, 2015

(54) METHOD OF CONTROLLING RETENTION AND AN INTERMEDIATE PRODUCT USED IN THE METHOD

(75) Inventors: Isto Heiskanen, Imatra (FI); Risto Laitinen, Imatra (FI); Jari Räsänen, Imatra (FI)

(73) Assignee: STORA ENSO OYJ, Helsinki (FI)

( * ) Notice: Subject to any disclaimer, the term of this patent is extended or adjusted under 35 U.S.C. 154(b) by 0 days.

(21) Appl. No.: 14/344,107

(22) PCT Filed: Sep. 12, 2012

(86) PCT No.: PCT/FI2012/050883

§ 371 (c)(1),
(2), (4) Date: Jun. 19, 2014

(87) PCT Pub. No.: WO2013/038061

PCT Pub. Date: Mar. 21, 2013

(65) Prior Publication Data

US 2014/0345816 A1 Nov. 27, 2014

(30) Foreign Application Priority Data

Sep. 12, 2011 (FI) ..... 20115893

(51) Int. Cl.

| | |
|---|---|
| ***D21H 21/16*** | (2006.01) |
| ***D21H 11/18*** | (2006.01) |
| ***D21H 15/02*** | (2006.01) |
| ***D21H 17/17*** | (2006.01) |
| ***D21H 17/28*** | (2006.01) |
| ***D21H 17/29*** | (2006.01) |
| ***D21H 17/55*** | (2006.01) |
| ***D21H 17/00*** | (2006.01) |
| ***D21H 21/10*** | (2006.01) |
| ***D21H 21/18*** | (2006.01) |
| ***D21H 21/20*** | (2006.01) |
| ***D21H 21/52*** | (2006.01) |

(52) U.S. Cl.

CPC ..... *D21H 21/16* (2013.01); *D21H 11/18* (2013.01); *D21H 15/02* (2013.01); *D21H 17/17* (2013.01); *D21H 17/28* (2013.01); *D21H 17/29* (2013.01); *D21H 17/55* (2013.01); *D21H 17/72* (2013.01); *D21H 21/10* (2013.01); *D21H 21/18* (2013.01); *D21H 21/20* (2013.01); *D21H 21/52* (2013.01)

(58) Field of Classification Search

USPC ..... 162/158, 127, 175

See application file for complete search history.

(56) References Cited

U.S. PATENT DOCUMENTS

| | | | | |
|---|---|---|---|---|
| 2010/0186916 | A1* | 7/2010 | Penniman | 162/173 |
| 2012/0241114 | A1* | 9/2012 | Axrup et al. | 162/127 |

FOREIGN PATENT DOCUMENTS

| | | | |
|---|---|---|---|
| EP | 0859011 | A1 | 8/1998 |
| FI | 117872 | B | 3/2007 |
| JP | 6-94639 | B2 | 11/1994 |
| JP | 11-36184 | A | 2/1999 |
| WO | WO 00/47628 | A2 | 8/2000 |
| WO | WO 01/66600 | A1 | 9/2001 |
| WO | WO 02/086238 | A1 | 10/2002 |
| WO | WO 2010/092239 | A1 | 8/2010 |
| WO | WO 2010/125247 | A2 | 11/2010 |
| WO | 2319984 | A1 | 5/2011 |
| WO | WO 2011/051882 | A1 | 5/2011 |
| WO | WO 2011/064441 | A1 | 6/2011 |
| WO | WO 2011/068457 | A1 | 6/2011 |
| WO | WO 2012/039668 | A1 | 3/2012 |

OTHER PUBLICATIONS

Finnish Search Report for FI-20115893 dated May 11, 2012.

http://en.wikipedia.org/wiki/Absorption_(chemistry), accessed May 10, 2012.

http://en.wikipedia.org/wiki/Adsorption, accessed May 10, 2012.

International Search Report for PCT/FI2012/050883 mailed on Dec. 12, 2012.

Miskiel et al., "Use of high amylose corn starch to improve the increase in paper strength attained by addition of microfibrilated cellulose", Research Disclosure, Dec. 1, 1999, 42806, Mason publications, Hampshire, GB, ISSN 0374-4353, XP007125106, pp. 1-3.

Schlosser, "Nano disperse cellulose und nanofibrillierte cellulose—neue produkte fur die herstellung und veredelung von papier und karton", Wochenblatt fur Papierfabrikation, 2008, vol. 136, pp. 252-263.

Written Opinion of the International Searching Authority for PCT/FI2012/050883 mailed on Dec. 12, 2012.

Subramanian et al., "Calcium Carbonate-Cellulose Fibre Composites; The Role of Pulp Refining", Paper Technology, 2006, pp. 27-31.

* cited by examiner

*Primary Examiner* — Mark Halpern

(74) *Attorney, Agent, or Firm* — Birch, Stewart, Kolasch & Birch, LLP

(57) ABSTRACT

The invention provides a method of controlling retention on a forming fabric in a paper making process, an intermediate product for use in the method, as well as use of material for the intermediate product. For making the intermediate product at least one paper making chemical is added to a slurry of fine cellulose fibres such as micro fibrillated cellulose (MFC), the specific surface area of those fibres being larger than that of the fibres of the main fibrous suspension for paper making, causing the paper making chemical being adsorbed on the fine cellulose fibres. This intermediate product is then incorporated in the main fibrous suspension before the suspension is supplied from the paper machine head box to the forming fabric. Other paper making chemicals may be added to the fibrous suspension before or after addition of the intermediate product, so that interactions between different chemicals are prevented. The invention permits an increased retention in general as well as improved control of retention of paper making chemicals separately and/or in relation to each other.

17 Claims, No Drawings

METHOD OF CONTROLLING RETENTION AND AN INTERMEDIATE PRODUCT USED IN THE METHOD

This application is a 371 of PCT/FI2012/050883 filed 12 Sep. 2012

THE FIELD OF THE INVENTION

The invention relates to a method of controlling retention on a forming fabric in a papermaking process. Other objects of the invention are an intermediate product intended to be added to a fibrous suspension used for papermaking, as well as use of material for this intermediate product.

BACKGROUND

In a papermaking process a number of papermaking chemicals are used for process control and to give required properties to the paper. The papermaking chemicals are dosed to the wet-end of a papermaking machine, by incorporation into an aqueous fibre suspension before it is fed from the headbox to the forming fabric. The goal is to have the chemicals adsorbed onto the surface of fibres by electrostatic forces.

The main difficulty in the simultaneous use of several papermaking chemicals, which are adsorbed on the fibre surface by similar mechanism, is how to achieve quantitative retention and an even distribution on fibre surface. Almost all additives have to compete for the free bonding (anionic, cationic, and neutral) sites on fibre surface. In most cases this leads to incomplete retention and/or uneven distribution of the chemicals on the fibre surfaces. As a result the quality of the finished paper suffers, and runnability problems will occur in the paper machine. In addition to inadequate retention and distribution, simultaneous use of several reactive additives may cause harmful interactive reactions between various papermaking chemicals and thus decrease their functionality and effect.

To improve the retention of papermaking chemicals as well as fines present in the fibrous suspension (amount of materials retained in the web being formed) a number of specific papermaking chemicals (retention chemicals) are conventionally used. The papermaking chemicals with a low retention to the fibre surface are accumulated in the white water system and can stick to paper machine surfaces as dirt, or to each other forming agglomerates. Such agglomerates can cause web breaks and dirty spots to the paper that is produced. Contrary to that good retention reduces the amount of fibre, filler and other chemicals passing to the paper machine short circulation and accumulating in the process system.

Papermaking chemicals which are used in high amounts are the main reason for harmful dirt precipitations in the paper machine and the resulting runnability and quality problems. Such papermaking chemicals include for example sizes, fillers and wet and dry strength giving chemicals.

The mechanism of chemical retention is that small particles (for example filler particles) are bonded as larger flocks, which the wet fibre web on the forming fabric can sustain. This flocculation can be achieved by use of different retention chemicals, which in most cases are water soluble polymers, polyelectrolytes.

In dual polymer systems two polyelectrolytes are used at the same time. Their difficulty in practice is that optimal conditions are hard to find and small process changes can affect a lot. Such dual systems work by having a short chain length polymer adsorb filler particles to its surface and thus form bonding points for a long chain polymer. In the first stage flocculation happens via mosaic formation and in the second stage by bridging.

Typical microparticle systems are for example:

- cationic starch/polyacrylamide +colloidal silica (for example the one which is sold under trademark "Compozil")
- polyacrylamide +bentonite (for example the one which is sold under trademark "Hydrocol")

As a first step of such a prior art process cationic polymer is added to the paper making pulp, and then just before the headbox very fine (particle size 250 nm-10 μm) and in most cases highly negatively charged (about 1 meq/g) microparticles are added. Microflocs are thus formed, and these have strong flocculation tendency even after the flocks have once been broken down. This can be seen in that the white water has a strong capacity to flocculate. Flocks which are formed are (compared to traditional retention chemicals) very small and this effect is even increased by the after flocculation. Flocculation in micro scale gives a high porosity to the web and thus dewatering is improved, the solids content after the press section is increased, and drying energy need is reduced.

DESCRIPTION OF THE INVENTION

The problem the invention seeks to solve is to bring about an overall improvement of retention of fibres and papermaking chemicals to the fibrous web formed on the forming fabric in the papermaking process. Such an improvement will diminish the amount of fibres and chemicals passing to the short circulation, deposited matter on the surfaces of tubes and chambers along the circulation route and agglomerates ending up as smudges in the paper being produced. Furthermore, the aim of the invention is to let the retention of a particular papermaking chemical be controlled, so as to make possible control of the retention of multiple chemicals contained in the papermaking suspension in relation to each other.

The solution according to the invention is a method, which comprises at least the following steps:

- providing a fibrous suspension for papermaking;
- providing a slurry comprising fine cellulose fibres, the specific surface area of said fine cellulose fibres being larger than that of the fibres of said fibrous suspension;
- adding at least one papermaking chemical to said slurry, said papermaking chemical being adsorbed on said fine cellulose fibres to form an intermediate product;
- incorporating said intermediate product in said fibrous suspension for papermaking; and
- supplying said fibrous suspension including said intermediate product onto the forming fabric.

The improved retention of fibres and papermaking chemicals on the forming fabric and subsequent pressing section shows as reduced concentration of the same in the paper/board machine short circulation and thus as reduced free floating, agglomeration and deposition of solid materials in tubes and other parts of the circulation system.

Without being bound to any theory, it is believed that the larger specific surface area of the fine fibres used for the intermediate product, as compared to that of refined pulps used for the basic papermaking suspension, makes it possible to adsorb a higher amount of papermaking chemicals, especially cationic papermaking chemicals, to the surface of the fibres. This applies in particular to very fine fibres such as microfibrillated cellulose (MFC) fibres, which have a huge open active surface and therefore are especially advantageous for use in the invention.

According to the teachings of the invention a large free surface is provided for adsorption/absorption of one or more papermaking chemicals. This is done by providing an aqueous slurry of fibers with an increased specific surface area. These may be dry cuttings, or more advantageously fibres or fibrils having a fibre diameter of less than about 200 nm, preferably less than about 50 nm, and most preferably less than about 20 nm, and a fibre length of 100 nm to 200 μm, preferably of 100 nm to 10 μm.

Herein the definition microfibrillated cellulose (MFC) refers to fibre material made of cellulose fibres, where the individual microfibrils or microfibril aggregates have been detached from each other. The fibres of MFC are usually very thin, the fibre diameter about 20 nm, and the fibre length is usually from 100 nm to 10 μm. The definition MFC as used herein also includes so called nano-fibrillated cellulose (NFC). However, as noted above the invention allows the fibrils have a larger diameter, up to 200 nm or more, and be longer, up to 200 μm or more. In some production methods some amounts of much longer and thicker fibres may remain.

Larger fibres, herein called fines, that may be used are fibres passing a screen of 200 mesh of Bauer-McNett apparatus. Nearly all fibres are shorter than 0,2 mm. Usually a pulp slurry containing such fines also contains variable amounts of MFC or NFC.

The term dry cuttings as mentioned above refers to wood fibres which have been cut from wood material in a dry state. These have a large open active surface into which papermaking chemicals may be adsorbed. The pulp slurry obtained by this method includes dry cut fibres and can be obtained for example by dry cutting method (with a whiley mill-type apparatus), compactor cutting method conical extrusion method.

Thus obtained pulp slurry comprises fibres, whose average length <1 mm. This kind of comparatively rough fines fraction usually comprise also finer fibres.

Different kinds of fibres or fibrils with a specific surface area larger than that of the basic papermaking suspension may even be used as mixtures. The effectiveness of a pulp slurry used as an adsorbent matrix for papermaking chemicals then depends on the proportion of MFC, fibre fines and dry cuttings in this pulp slurry. The mutual proportion of MFC, fibre fines and dry cuttings in pulp slurry depends on, for example, the origin (cellulosic or lignocellulosic raw material) and the production method (chemical, chemimechanical or mechanical pulps) of the pulp slurry.

According to an embodiment of the invention a single papermaking chemical is adsorbed to cover the available surface of the fibrillated cellulose fibres. As an alternative a first papermaking chemical may be adsorbed to a part of the available surface of the fibrillated cellulose fibres, and thereafter a second papermaking chemical is adsorbed to the remaining part of the available surface of the fibrillated cellulose fibres. The relative amounts of the chemicals contained in the intermediate product and finally retained on the forming fabric may thereby be controlled.

Generally the fibrillated cellulose fibres form a major component of the intermediate product. Measured by weight their amount may be at least as large as, and preferably larger than, the total amount of papermaking chemical(s), selected from hydrophobic sizes, wet and dry strength sizes, flocculation improving chemicals and fillers, in said product.

Preferably the weight ratio of the adsorbing cellulose fibres to one or more papermaking chemicals in the intermediate product varies between 20:1-1:1.

After a papermaking chemical is adsorbed to the fibres in the pulp slurry, it is possible to flocculate the fibres by use of a polyelectrolyte or chemicals with similar working mechanisms. This flocculation is very effective due to dimensions and active surface of the fibres used in the invention, in particular MFC fibres. After this the intermediate product with pre-flocculated fibres can be dosaged to the fibrous papermaking suspension at the wet end of the paper machine.

According to another embodiment of the invention one or more further papermaking chemicals are incorporated in the fibrous suspension for papermaking, before or after incorporation of said intermediate product therein. In this way unwanted chemical interactions between the papermaking chemicals introduced in the intermediate product and said further papermaking chemicals can be reduced or completely avoided. Also the quantitative retention of said further papermaking chemicals can be increased as a result.

A significant advantage of the invention over prior art methods is that it will be possible to adsorb a much higher load of papermaking chemicals than before onto the fibrous suspension in the wet-end of the papermaking machine. This has been made possible on one hand by adsorbing such papermaking chemicals (adsorbants) onto the surface of fine cellulose fibres (adsorbate) and then by adding this as an intermediate product to the fibrous suspension in the wet-end of the papermaking machine, or on the other hand by adding them to the fibrous suspension at a separate step so that those chemicals do not interact with the chemicals introduced as part of the intermediate product.

This is important for papermaking chemicals, which are advantageously used in high amounts during the normal papermaking process. These papermaking chemicals include sizes such as hydrophobic sizes (for example AKD or ASA), flocculation facilitating agents such as cationic polyelectrolyte or cationic starch, anionic polyacrylamide, bentonite, paper wet- or dry-strength increasing chemicals such as starch or a resin, and fillers such as clay, PCC (precipitated calcium carbonate) and $CaCO_3$.

Generally, papermaking chemicals herein refer to all non-fibrous substances used during a papermaking process. Papermaking chemicals include process chemicals and functional chemicals. The papermaking chemicals may be cationic, neutral or anionic. Functional papermaking chemicals affect to the properties of paper/board to be prepared. Without being limited to them these include sizes, chemicals giving wet strength or dry strength to the paper/board web, fillers, chemicals, pigments, special pigments, bentonite, dye colours, optical brighteners, fluorochemicals for resistance to grease etc. Papermaking process chemicals includes chemicals which improves runnability of the paper/board web or fibrous fabric in the wet or dry end of the paper/board making process but also usually indirectly properties of paper/board to be prepared. Without being limited to them, these include alum, retention chemicals, water removing chemicals, dispersing chemicals, chemicals blocking forming of gum or foam.

The papermaking chemicals particularly preferred in the invention are sizes, such as hydrophobic sizes, e.g. alkyl ketene dimer (AKD) or alkenyl succinic acid anhydride (ASA), as well as wet and/or dry strength sizes, e.g. polyamidoamine epichlorohydrin (PAAE).

A preferable way of combining the intermediate product with the main papermaking suspension is to add it to paper machine short-circulation, comprising use of circulated white water to dilute the suspension before the suspension is supplied from a headbox to the forming fabric. Most preferably the intermediate product is added to a diluted suspension just before the headbox. As regards diluting of the papermaking suspension in general, the fibrous suspension may be diluted to a consistency of at most 1.2 wt. %, preferably in the range of 0.1 to 0.8 wt. %, before entering the headbox.

However, it is also possible that the intermediate product is added to the fibrous suspension separately from the short-circulation. In this case the intermediate product may be added to undiluted thicker stock before the inlet of the circulated white water.

Regarding preparation of the intermediate product, the papermaking chemical may be added to the slurry of MFC or other fine cellulose fibres by use of a mixer, advantageously an injection jet mixer, forming the intermediate product. Mixing can be done before or at the same time as the intermediate product is injected to the fibrous suspension. Preferably the intermediate product is injected to the suspension by use of the jet mixer after dilution of the suspension with short-circulated white water.

Injection jet mixers, for instance Trumpjet type, are advantageous for use in the invention as they produce high shear and are able to disperse the intermediate product into the main fibrous suspension flow. This is important for achieving proper mixing and avoiding MFC flocculation, which would otherwise occur very quickly.

The fibre content in an aqueous slurry, before addition of one or more papermaking chemicals to form the intermediate product, may be 1-5 wt. %, preferably 2-3 wt. %.

Alternatively, the intermediate product may be added to circulated white water before it is used for diluting the fibrous suspension. The fibre content of the white water may be as low as 0.05-0.2 wt-%, and is not increased appreciably by addition of the intermediate product. An injection jet mixer may be used for mixing and injection even in this embodiment.

Preferably the fibres are combined with the papermaking chemical in wet form. For instance, AKD is available as a 15 wt. % aqueous dispersion, which could be added to an aqueous slurry of MFC. However, MFC or other fine cellulose fibres could also be mixed with the papermaking chemical in dry form, followed by turning the mixture to a slurry by addition of water.

The main fibrous suspension for papermaking may comprise chemical pulp such as kraft or sulphite pulp, chemithermomechanical pulp (CTMP), thermo-mechanical pulp (TMP), mechanical or recycled pulp or the like, used alone or in mixtures. The terms paper, papermaking, papermaking process and papermaking machine refer not only to paper but also to paperboard and cardboard, respectively.

The intermediate product according to the invention consists of a cellulosic or lignocellulosic slurry, which comprises fibrillated cellulose fibres and at least one papermaking chemical adsorbed on said fibrillated cellulose fibres. The intermediate product is intended to be added to a fibrous suspension before the suspension enters the headbox of a papermaking machine.

Measured by weight, the amount of fibrillated cellulose fibres in the intermediate product is preferably at least as large as, and more preferably larger, than the total amount of papermaking chemicals in the same.

Preferably the intermediate product comprises microfibrillated cellulose fibres (MFC). Preferred papermaking chemicals in the slurry include hydrophobic papermaking sizes such as AKD or ASA, wet-strength papermaking sizes such as PAAE, paper sizes for improving the dry-strength of the paper such as starch, and flocculation improving chemicals such as a cationic polyelectrolytes and cationic starch.

As applicable, the features and embodiments of the method according to the invention as described above concern the intermediate product according to the invention as well.

The invention even includes use of microfibrillated cellulose fibres (MFC) as an adsorbent for a papermaking chemical, to make an intermediate product to be added to a fibrous papermaking suspension. Examples of preferred papermaking chemicals are hydrophobic papermaking sizes such as AKD or ASA, wet-strength papermaking sizes such as PAAE, paper sizes for improving the dry-strength of the paper such as starch, and flocculation improving chemicals such as a cationic polyelectrolytes and cationic starch.

EXAMPLES

Common features in the examples are:

MFC, dry cutted fibres or fibre fines with high open surface area is pre-treated with (extremely) high AKD load. This sizing agent preloaded to fibrous material is then introduced into the process by jet-injection (for example TrumpJet®) type metering device. Prechelating the treated fibrous material with the retention aid generates effective retention and also increases the strength properties of board.

The jet-injection is done just before headbox, which decreases the dissolution tendency of retained chemicals caused by PM process mechanical shear forces. Described method makes also possible to introduce plugs, formed by micro fibrous and/or micro particles, with high hydrophobicity into the board structure. These hydrophobic plugs are able to block the open capillary structure by high hydrophobicity. This combination of fibre particles with high hydrophobicity and steric hindrance is able to eliminate the problems (REP) connected to sizing of bulky boards.

On the other side, most of AKD is bonded to fibre carrier flocs before to be introduced into the process, which would automatically increase significantly the total AKD retention.

MFC-fibre preload with sizing agents is done on pure, chemically untreated fibre surface, which confirms highest possible size retention and minimizes the possible harmful interactions between sizing agent and other paper chemical additives Z- and dry-strength of the board is generated by sizing agent (wet-/dry-strength agents) pre-treated MFC, dry cutted pulp or other particulous fibre materials. The surface of these fibrous particles is highly loaded by strength-sizing agent and is thus able to generate strong fibre-fibre bondings.

The three dimensional structure of these "pre-treated particles" is better able to form cross bondings in bulky fibre network than traditional strength sizing methods. By using this method only part of the fibre network material is treated by wet- or dry strength agent. The rest of the free fibre area can better be used for example for hydrophobic sizing.

To focus the active strengthening agent in high doses on the selected fibre particles with high (bonding) surface area the bonding strength can be increased and focused on the most critical areas of fibre network.

Example 1

Board was produced with pilot board machine;

furnish 100% CTMP, 150 gsm typical liquid packaging board chemicals (starch, dual component retention chemicals ext.)

Reference; AKD-dosage to the thick stock (levelling box), wire retention 91%, AKD retention 23%

Trial 1; AKD was premixed with MFC (ratio 1:9), dosage just before head box (TrumpJet®), wire retention 93%, AKD retention 29%

Trial 2; just before dosage AKD was mixed with T-bar with MFC (ratio 1:9), dosage just before head box (TrumpJet®), wire retention 94%, AKD retention 32%

Trial 3; AKD was premixed with MFC (ratio 1:9), and this was mixed just before dosage with C-PAM 100g/t (TrumpJet®), wire retention 93%, AKD retention 54%

*)TrumpJet® here refers to commercial high speed injection chemical mixing/dosing system sold by Wetend Technologies.

Example 2

Fine paper surface produced with pilot paper machine.

furnish 100% bleached birch kraft, 65 gsm typical chemicals used in fine paper furnish (filler, dual component retention chemicals ext.)

Reference; ASA dosaged to the short circulation (mixing pump),: wire retention 50%

Trial 1. 0.5 kg/t ASA+0.5 kg/t MFC TrumpJet® with T-bar+100 g/t C-PAM (TR2), wire retention 64%.

Trial 2. 0.5 kg/t ASA+5 kg/t MFC premix with TrumpJet® and 100 g/t T2: wire retention 64%

Trial 3. 0.5 kg/t ASA +35 kg/t dry cutted pulp premix with TrumpJet®; no (?) C-PAM addition: wire retention 70%.

The invention claimed is:

1. A method of controlling retention on a forming fabric in a papermaking process, said method comprising at least the following steps:

providing a fibrous suspension for papermaking;

providing a slurry comprising fine cellulose fibers, the specific surface area of said fine cellulose fibers being larger than that of the fibers of said fibrous suspension;

adding at least one papermaking chemical to said slurry, said papermaking chemical being a hydrophobic size which is a member selected from the group consisting of alkyl ketene dimer (AKD) and alkenyl succinic acid anhydride (ASA), said papermaking chemical being adsorbed on said fine cellulose fibers to form an intermediate product;

incorporating said intermediate product in said fibrous suspension for papermaking; and supplying said fibrous suspension including said intermediate product onto the forming fabric.

2. The method of claim 1, wherein said fine cellulose fibers are fibrillated fibers having a fiber diameter of less than about 200 nm.

3. The method of claim 2, wherein the fibrillated fibers have a fiber length of 100 nm to 200 μm.

4. The method of claim 3, wherein the fibrillated fibers have a fiber diameter of less than 20 nm and a fiber length of 100 nm to 10 μm.

5. The method of claim 2, wherein said slurry comprises microfibrillated cellulose fibers (MFC).

6. The method of any one of claims 2, 3, or 5, wherein a single papermaking chemical is adsorbed to cover the available surface of the fibrillated cellulose fibers.

7. The method of claim 1, wherein a first papermaking chemical is adsorbed to a part of the available surface of the fibrillated cellulose fibers, and thereafter a second papermaking chemical is adsorbed to the remaining part of the available surface of the fibrillated cellulose fibers.

8. The method of claim 1, wherein the amount by weight of fibrillated cellulose fibers in the intermediate product is at least as large as the total amount of one or more papermaking chemicals in said product.

9. The method of claim 8, wherein the weight ratio of fibrillated cellulose fibers to one or more papermaking chemicals is between 20:1-1:1.

10. The method of claim 8, wherein the amount by weight of fibrillated cellulose fibers in the intermediate product is larger than the total amount of one or more papermaking chemicals in said product.

11. The method of claim 1, wherein said intermediate product is added to short-circulation of white water, which is used for diluting the fibrous suspension before the suspension is supplied from a headbox to the forming fabric.

12. The method of claim 1, wherein said intermediate product is added to the fibrous suspension before said suspension is diluted with short-circulated white water.

13. The method of claim 1, wherein one or more further papermaking chemicals are incorporated in the fibrous suspension for papermaking, before or after incorporation of said intermediate product therein.

14. The method of claim 1, wherein the fibrous suspension is diluted to a consistency of at most 1.2 wt. % before entering the headbox.

15. The method of claim 14, wherein the fibrous suspension is diluted to a consistency in the range of 0.1 to 0.8 wt. % before entering the headbox.

16. The method of claim 1, wherein said papermaking chemical is added to the slurry by use of a mixer, which mixes the fibrillated cellulose fibers with the papermaking chemical to form the intermediate product before or at the same time as the intermediate product is injected to the fibrous suspension.

17. The method of claim 16, wherein said mixer is an injection jet mixer.

* * * * *